United States Patent [19]

Langenhorst

[11] 4,344,258

[45] Aug. 17, 1982

[54] DEVICE FOR MOUNTING A DOOR LEAF IN A DOOR OPENING

[75] Inventor: Günter Langenhorst, Bad Sassendorf, Fed. Rep. of Germany

[73] Assignee: Top-Element Bauelemente für Innenausbau & Raumgestaltung GmbH & Co. KG, Hamm, Fed. Rep. of Germany

[21] Appl. No.: 222,764

[22] Filed: Jan. 6, 1981

[30] Foreign Application Priority Data

Jan. 8, 1980 [DE] Fed. Rep. of Germany ..... 3000454

[51] Int. Cl.[3] ..... E06B 1/04

[52] U.S. Cl. ..... 49/504; 52/213

[58] Field of Search ..... 49/504, 505; 52/213–215

[56] References Cited

U.S. PATENT DOCUMENTS 3,546,815 12/1970 Kimberly ..... 49/504

4,251,962 2/1981 Langenhorst ..... 49/504 X

FOREIGN PATENT DOCUMENTS 2345232 3/1975 Fed. Rep. of Germany ..... 49/504

*Primary Examiner*—Philip C. Kannan

*Attorney, Agent, or Firm*—Karl F. Ross

[57] ABSTRACT

A device for mounting a door in a door opening defined by at least one wall edge, e.g. for a desk, cabinet or building structure, comprises a door frame member in the form of a U-profile which straddles this edge and is affixed thereto. According to the invention, on the edge turned toward the opening, the wall is provided with a mounting element having a rib projecting in the direction of the opening which is clamped against a retaining profile received within the frame member by the movement of a wedge by a screw which is inserted through a hole in the frame member and has its head located within a rabbet for the door set into the frame member. The retainer also has a flange which cooperates with a clamping member actuated by another screw located at the rabbet to engage a shank of a hinge pin or like element.

10 Claims, 10 Drawing Figures

DEVICE FOR MOUNTING A DOOR LEAF IN A DOOR OPENING

FIELD OF THE INVENTION

My present invention relates to a device for mounting a door leaf in a door opening and, more particularly, to a combination frame and hinge mounting system adapted to create a door frame in an opening and to mount the hinge for the door leaf on this frame.

BACKGROUND OF THE INVENTION

It is frequently desirable to mount a door leaf or panel hingedly within a framed opening in a wall, for example, in the wall opening of a cabinet, desk or the like in which the wall opening is formed by edges of the wall which are to be received in profiled frame members designed to frame out the opening, form the usual door rabbet in which the leaf is set and provide the means for carrying the hinge or hinges upon which the door is swingably mounted.

The mounting of such frame members in place and the subsequent attachment of hinge elements for mounting the door on the frame members is a time-consuming, often complex, process which may require dexterous personnel with considerable experience.

It is known to provide in such systems, a U-section frame profile which receives an upright (for example) wall edge and is secured thereto by a clamping device while being formed with the rabbet mentioned previously.

In conventional systems almost universally there is encountered a problem in hanging the door leaf or panel and in effectively transmitting the forces of the hung door to the edge of the wall.

When the wall opening is framed by wood sandwiched between sheets of plaster board, for example, the transmission of forces to the wall upon hanging of the door creates stresses which tend to damage the structure forming the door opening, notwithstanding the fact that the latter is generally framed out.

When efforts are made not to transmit forces to the wall structure and to confine the door suspension stresses to the frame members, the frame members tend to be deformed and, because the shanks of the U-profile member straddle the flanks of the wall adjoining the edges with only limited play or with no play at all, the deformation of the frame member may in turn damage the wall.

The appearance of the door structure, framing and wall may be adversely affected as may the structural integrity thereof.

In fact, when a hinge is applied directly and exclusively to the relatively thin member constituting the profile of the door frame, distortion of the latter is almost unavoidable.

OBJECTS OF THE INVENTION

It is, therefore, the principal object of the present invention to provide an improved door mounting device, especially of the frame and hinge type, which is free from the disadvantages of earlier systems.

More specifically it is an object of the invention to provide a door frame and hinge assembly which allows the mounting of a door in a door opening with a minimum of damage to the structure and distortion of the door frame member.

Yet another object of the invention is to provide a simple and rapidly mounted door frame and hinge assembly which can be utilized with a minimum transfer of stress to the wall and with effective stress distribution in the frame member.

It is still another object of my invention to provide a device of the type described which permits mounting of a door hinge assembly in the door opening of a wall with the ability to compensate for all kinds of construction tolerances.

SUMMARY OF THE INVENTION

These objects and others which will become more apparent hereinafter are attained in an assembly for swingably mounting a door in the door opening of a wall having at least one wall edge turned toward this opening and which comprises a U-profile door frame member receiving this edge and, within the door frame member, a clamping device operated by a screw actuatable at a rabbet of the frame member in which the door leaf or panel can be received.

According to the invention, the clamping member has at least one wedge surface and is directly engaged by the clamping screw to lock an upstanding surface attached to the wall edge against a counter-surface of a U-profiled retainer which is fitted into the frame member and also straddles the edge of the wall. The retainer or holding profile in the hinge region comprises an anchoring flange with one or more recesses against which one or more anchoring bolts or pins are braced via a clamping member actuatable by a clamping screw access in the rabbet region of the frame, the bolt or pin carrying one member (e.g. a pintle) of a hinge, another member of which, e.g. an eye, can be carried by the door leaf or panel. The bolts or pins can pass through respective bores in the associated shank of the frame profile.

The system of the present invention allows initially the connection of the door frame member to the upright wall of the structure provided with the door opening, utilizing a simple and reliable wedge-type clamping device in an especially rapid manner, the clamp actuator being readily accessible at the rabbet.

Thereafter, also utilizing a clamping arrangement actuatable from the exterior of a frame member, a bracing-type clamping device enables the reliable and adjustable attachment of a hinge element via a pin or bolt thereof. Since the clamping is effected in part by the retainer, sufficient structure is provided between the retainer and the frame member to support the hinge element against the forces which result when the door is suspended and these forces are no longer applied solely to the frame profile or to the door edge. The retainer, which is also a U-profile, distributes the door suspension forces to a large area of the frame member and to the edge of the door-opening structure via the first or wedge-clamping device.

It has been found to be advantageous to provide the hinge element, e.g. the pintle or hinge pin, with two such anchoring bolts or pins which may be smooth-surfaced or may be threaded for reasons which will be apparent hereinafter.

The frame profile and the retainer profile may be composed of metal and advantageously the frame profile is a metal extrusion, while the retainer profile may be stamped or bent from sheet metal. The clamping wedge can be composed of a synthetic resin material in which case the threaded bore in the clamping wedge, which is directly engaged by the first clamping screw, can be formed in a threaded bushing which is embedded in the clamping wedge to provide an effective low-wear threaded connection between the clamping screw and the wedge.

The term "profile" is used herein to refer to a structural member which has a plurality of angularly adjoining webs or flanges or shanks and preferably is of U-section, i.e. of channel construction.

According to the invention, the counter-surface which engages the projecting rib on the door edge and forms part of the clamping member, and the inclined surface with which the wedge member cooperates to bring about the clamping action, are formed by stamping the retainer profile or be flanges or surfaces bent from this stamping.

The counter-surface and the associated wedge surfaces can be formed as ribbed, ridged, saw-tooth or other zig-zag surfaces to minimize the danger of reverse slip once the clamp is tightened.

When the inclined guide surface for the wedge is formed exclusively by a single stamping from the retainer profile, the wedge can be provided with a corresponding guide groove in which this inclined surface is received, thereby holding the wedge on the retainer.

In a preferred embodiment of the invention, the retainer profile has a horizontally extending stamped window with upper and lower abutment surfaces as well as, at predetermined distances from these surfaces, upper and lower parallel edge bends. Each of these edge bends or ribs together with the opposite abutment surface forms a double wedge engageable with two surfaces of the clamping wedge, one of these surfaces forming the bearing surface while the other is the guide or inclined surface.

This arrangement has been found to be especially effective for door mountings in which the frame is inverted or laterally reversed.

According to a further feature of the invention, the clamping device for the bolts or pins of the hinge element is received in a cutout, opening or recess of the anchoring flange of the retainer element and this flange in the region of its bearing recess carries a U-shaped clamping member whose shanks have corresponding recesses and straddle the recessed portion of the anchoring flange. A lever, operated by a screw, presses this U-shaped clamping member against the bolts or pins of the hinge element and thereby presses these bolts or pins against the anchoring flange. The lever, in turn, bears against the retainer or the frame profile to effect the clamping action. As a consequence, the actuation of the clamping screw affect the clamping action of the hinge element adjustably in place.

This arrangement of the clamping device has a simple construction and the further advantage that the clamping device is relatively flat so that it can fit easily between the frame profile and the wall in the region of the retainer.

The frame profile and/or the retainer can be formed with a ridge or like profiling in the region at which the lever bears thereupon for effective pivoting action of the lever. The retainer can be formed with a window through which this profiling of the frame member can be exposed when the lever bears directly upon the latter. The entire clamping device, in this construction, can be scarcely thicker than the retainer itself.

The frame and hinge mounting device of the present invention can be used to mount a door leaf in the door opening of any wall structure with simple manipulation and with high speed, thereby minimizing the labor requirements. Furthermore, the door-suspending forces can be transmitted over a significant portion of the door frame member and the adjoining wall, thereby eliminating deformation of the frame members or damage to these or the wall. The clamping device for the hinge element and the clamping wedge both can be actuated from the exterior and hence it is not necessary to reach behind the frame member and possibly damage any seals between the latter and the wall. In addition, full adjustability of the frame member and the hinge is ensured.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 7:
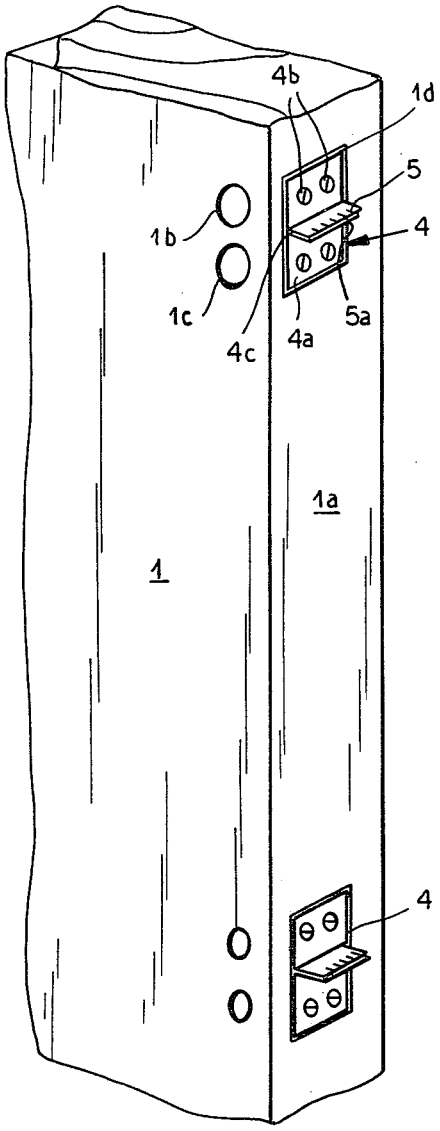
FIG. 7 is a perspective view showing the upright wall edge defining the door opening and upon which the frame member of FIG. 1 is to be mounted.

In FIG. 7 I have shown a wall 1 in which a door opening is formed, this wall having an edge 1*a* adapted to be received in a channel-shaped frame member 2 as will be described in greater detail below. The wall 1 is formed, at the hinge sites, with a pair of throughgoing holes 1*b* and 1*c* which, as will be apparent hereinafter, serve to receive the bolts or pins 14 of a hinge element.

At each hinge site, in addition, there is provided a mounting element generally represented as 4 and which can be a T-shaped member, as shown, having a plate 4*a* lying in a recess 1*d* in the edge 1*a* and anchored therein, e.g. by screws 4*b* as shown. The plate 4*a* can have an upstanding flange 4*c* which thus projects from the edge 1*a* and forms an abutment surface 5 which can be serrated, milled, roughened or otherwise shaped as shown at 5*a* to resist disengagement once the clamping wedge has been tightened. As can be seen from FIG. 7, moreover, two such mounting elements 4 are provided in vertically spaced relationship signifying that the edge 1*a* will be formed with two hinge sites.

The device for mounting a door leaf or panel (not shown) in the door opening of the wall 1 comprises a U-shaped channel profile member 2 forming one upright of a door frame which is provided with the door rabbet 3, i.e. a step constituting a recess in which the door leaf is received in the closed position of the door. The frame profile 2, which can be extruded from light metal such as aluminum or an alloy thereof, comprises an end plate 2*a* (FIG. 3) turned toward the center of the door opening, a vertical flange 2*b* overlying the wall edge on one side thereof, a vertical flagne 2*c* overlying the wall 1 on the opposite side thereof, inwardly turned portions 2*d* and 2*e* which space the flanges 2*b* and 2*c* from the respective sides of the wall 1, and inwardly turned ridges 2*f* and 2*g* which form sealing members cooperating with the wall 1 and preventing the passage of moisture into the space enclosed by the frame profile.

In addition, the frame profile comprises a wall portion 3*a* projecting perpendicularly to the edge 1*a* and defining one flank of the rabbet 3, the other flank of which is defined by a wall 3*b* extending parallel to the edge 1*a* and formed with an inwardly projecting ridge 26 the function of which will be described in greater detail hereinafter.

Along the wall 3*a*, a pair of ribs 3*c* and 3*d* can extend perpendicular to this wall and hence parallel to the edge 1*a*, these ribs being of T-section and being adapted to receive a strip of sealing material as well as the heads of the clamping screws which affix the frame profile 2 to the mounting elements 4.

Figure 1A:
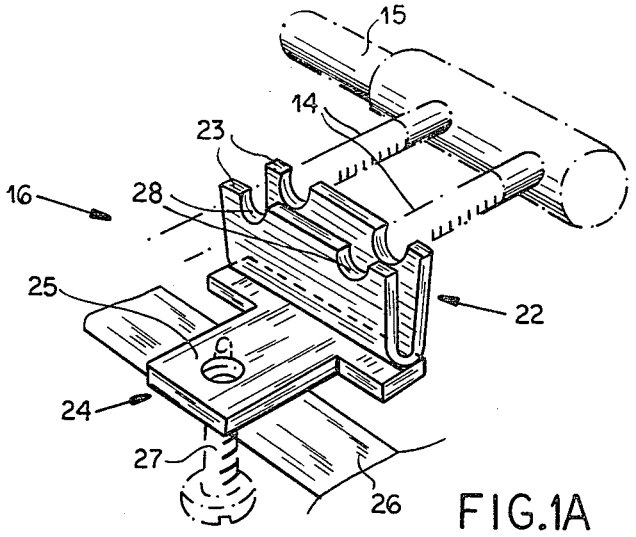
FIG. 1A is a perspective view of a detail in the region IA showing the clamping device for locking the hinge element in place.
Figure 1:
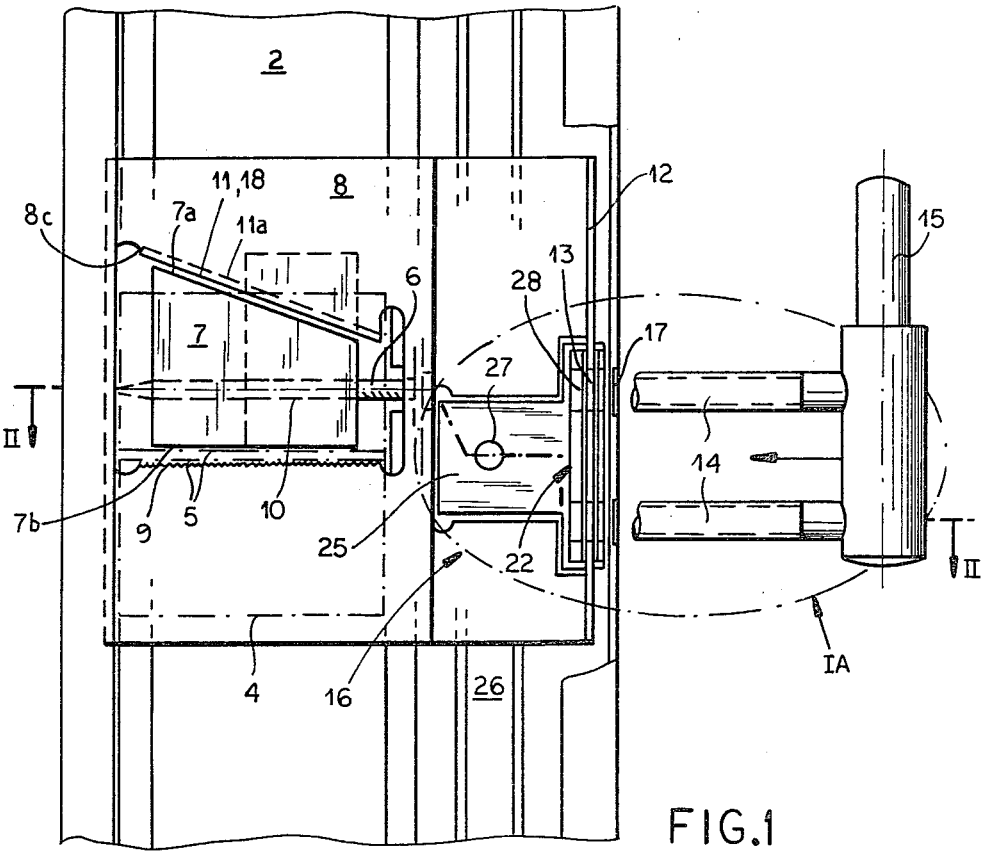
FIG. 1 is an elevational view, partly broken away, of the device of the present invention seen from the inside of the channel forming the frame member with the mounting elements on the wall shown in dot-dash lines.
Figure 2:
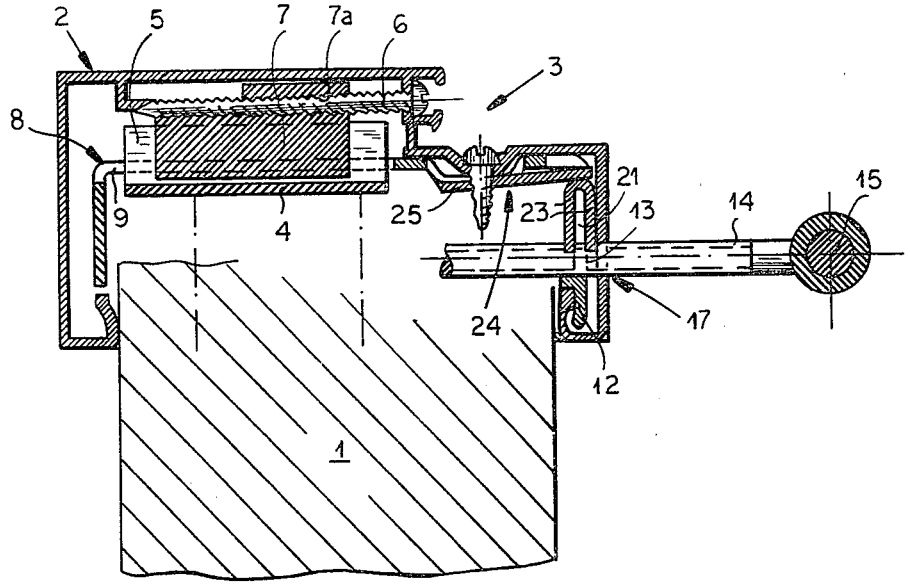
FIG. 2 is a horizontal section taken along the line II—II of FIG. 1 with a portion of the wall removed.
Figure 8:
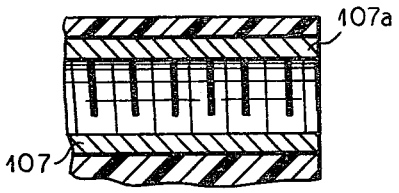
FIG. 8 is a fragmentary section of a portion of a wedge member in accordance with another embodiment of the invention.

These screws 6 are received directly in threaded bores of clamping wedges 7, one such wedge 7 being provided at each hinge site in the embodiment of FIG. 1. As illustrated in FIGS. 1 and 2, the wedge 7 is composed of metal and hence has its bore 7*a* threaded directly. However, when the wedge member is injection molded of synthetic resin material, as shown at 107 in FIG. 8, an internally threaded metal sleeve 107*a* is embedded in the synthetic resin material to receive the screw 6.

As noted, the mounting elements 4 have clamping surface 5 orthogonal to the edge 1*a* which project into the space between the wedge 7 and a counter-surface 9. As the wedge 7 is drawn to the right (FIG. 1), the wedge locks against member 5 which in turn is locked against member 9.

Figure 3:
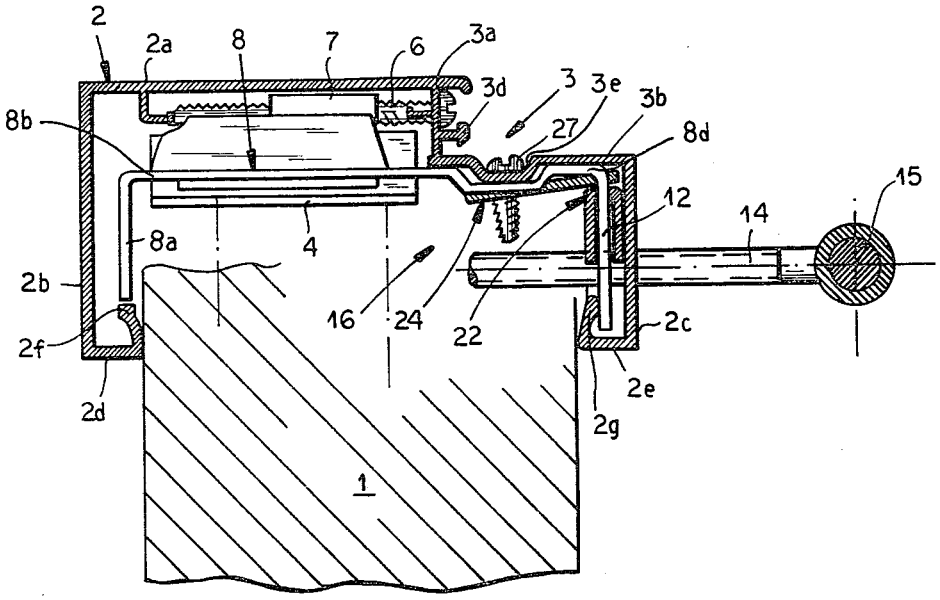
FIG. 3 is a horizontal section through the frame member showing the clamping wedge and the bolt clamp in a plan view.

According to the invention, a U-shaped retainer 8 which can be stamped from sheet metal, is provided within the frame profile 2 and comprises as can be seen in FIG. 3, a flange 8*a* extending perpendicular to the edge 1*a*, a horizontal web 8*b* provided with a generally trapezoidal window 8*c* (FIG. 1), a further window or opening 21 and an anchor flange 12 extending parallel to the flange 8*a* and which will be described in greater detail hereinafter. The window 8*c* receives the clamp member 7 and the upstanding flange 4*c* with its surfaces 5.

In addition, this window has an edge which defined the counter-surface 9 against which the clamping surface 5 is held and an inclined edge 11 forming a guide edge for the wedge 7 which can be grooved to receive the edge 11 when the latter is not provided with a bent portion to increase the guide surface. Such a bent portion is shown in broken lines at 11*a* or 18 in FIG. 1.

As is apparent from FIG. 3, moreover, the screw 6 is rotatable in the wall 3*a* of the rabbet 3 between the ridges 3*c* and 3*d* and, upon rotation, draws the wedge 7 to the right because the wedge 7 has an inclined flank 7*a* riding upon the inclined surface 11 of retainer 8, the wedge 7 clamps with its opposite surface 7*b* against one of the surfaces 5 of the flange 4*c* and presses the surface 5 thereof against the counter-surface 9.

The anchor flange 12 in the region of the hinge or some other door mounting member, has one or more bearing recesses 13 which can be in the form of bores or notches (preferably bores) through which one more anchor bolts 14 on a hinge pin 15 can pass. The hinge pin 15 represents any element for suspending the door leaf from the device. The bolts 14, although they do not rotate, are provided with screw threads so that the clamp can obtain effective purchase upon these bolts.

Internally of the frame profile 2, I also provide a clamping arrangement 16 which straddles the anchor flange 12 and fits into the recess 21 in the latter.

The wall 2*c* is provided with bores 17 through which the bolts 14 pass, the bores 17 registering with the bores 1*b* and 1*c* previously described.

The bores 17 can have a slightly greater diameter than the bores or recesses 13 to allow tolerances in mounting of the retainer 8 and the clamping device 16 to be compensated.

The openings 8*c*, 21 can be windows simply stamped or punched in the retainer 8 or can be flanked by bent portions of this member as represented at 18.

The clamping surfaces 5, the pressing surface 7*b* of the wedge 7 and the counter-surface 9 can be roughened or provided with a saw-tooth configuration to enable strong slip-free clamping. The surface 9 can also have a chiselshaped array of notches or indentations for this purpose.

Figure 5:
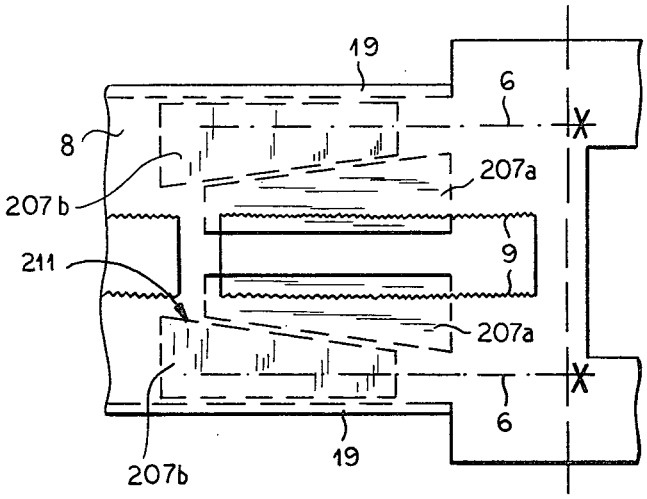
FIG. 5 is a fragmentary elevational view schematically illustrating a modification of the clamping wedge arrangement of the device of FIG. 1.
Figure 6:
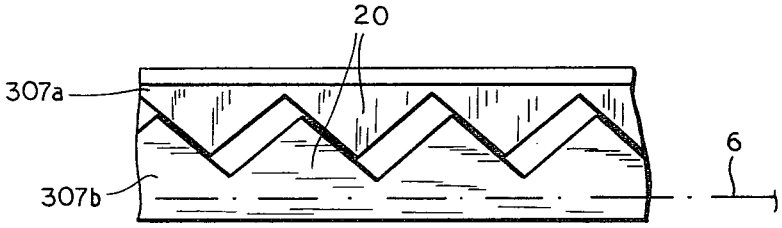
FIG. 6 is an elevational view illustrating a modification of the device of FIG. 5.

In FIG. 5 I have shown an alternative construction of the retainer 8 which can be formed, by a horizontal stamping with upper and lower counter-surfaces 9 and a pair of bent ridges 19 formed from the sheet metal of member 9 and extending parallel to the counter-surface 9 respectively above and below them. Between each ridge 19 and the surface 9, a respective double wedge 207*a*, 207*b* forming the guide surface 211 can be provided, the wedge members 207*b* being held against the displacement or being shifted by the screw while members 207*a* are shifted or held against displacement respectively. Separate clamping screws can be provided for the movable members of the wedge. In FIG. 6 I have shown a pair of interengageable wedge members 307*a* and 307*b* which have mutually engaging saw-tooth formations 20 to provide the wedging action.

The clamping device 16 comprises, in addition to the U-shaped clamping member 22 which straddles the flange 12 and is received in the opening 21, a clamping lever 24 which is connected to member 22 at the bight thereof.

The lever 24 rests and is fulcrumed at its end 25 remote from member 22, upon the abutment constituted by the ridge 26 previously mentioned. A clamping screw 27 can be threaded into the end 25 of lever 24 after traversing the wall 3*b* of the rabbet 3, the head of the screw 27 being countersunk below the upper surface of wall 3*b* in a crough 3*e* formed by the ridge 26.

Figure 4A:
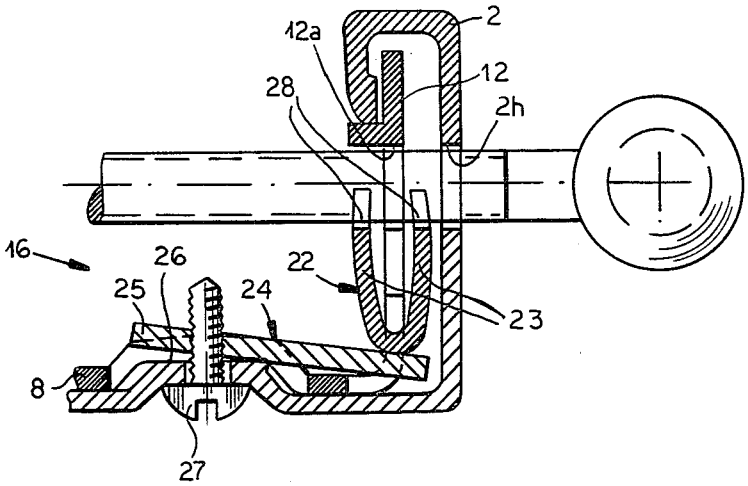
FIGS. 4A and 4B are detail views in section and drawn to a larger scale illustrating the clamping device in the free and locked positions respectively.
Figure 4B:
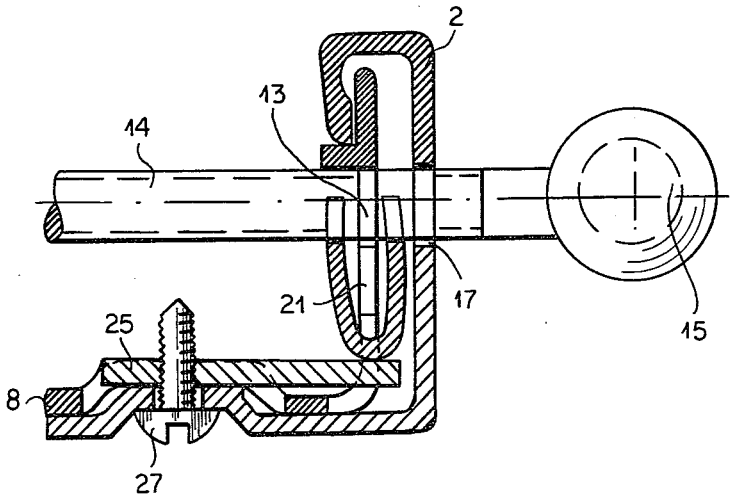

When the screw is tightened, the free end of the lever 25 is drawn against the abutment 26, pressing member 22 with its shanks 23 against the bolts 14 (compare FIGS. 4A and 4B).

The shanks 23 of member 22 have bearing recesses 28 engaging the bolts and adapted to rest thereagainst, thereby locking the bolts against the surfaces 2*h* of the wall 2*c* and 12*a* of the flange 12.

I claim:

1. A door mounting device for a door leaf in a door opening of a wall having an edge turned toward said opening, said device comprising:

at least one mounting element on said edge having a clamping surface projecting transversely from said edge;

a profiled frame element enclosing said edge and said mounting element, said frame element being formed with a door rabbet;

a retainer disposed in said frame element in the region of said mounting element and formed with a counter-surface extending parallel to said clamping surface;

first clamping means in said frame element including a wedge displaceable relative to said retainer for clamping said clamping surface against said counter-surface, and a clamping screw traversing a wall of said rabbet, threaded directly into said wedge and rotatable to actuate said wedge, said retainer having an anchor flange extending transversely to said edge and provided with at least one recess;

a door-suspending member having at least one bolt passing through said frame element and said recess; and second clamping means in said frame element operable by a further screw traversing a wall of said rabbet for locking said bolt.

2. The device defined in claim 1 wherein said wedge is composed of synthetic resin material and is provided with an internally thread metal sleeve embedded therein and receiving said screw of said first clamping means.

3. The device defined in claim 1 wherein said retainer is formed with an inclined guide surface along which said wedge rides, said guide surface and said counter-surface being formed along edges of a window in said retainer receiving said wedge.

4. The device defined in claim 1 wherein said retainer is formed with bent ridges spaced from respective counter-surfaces, said wedge including a pair of wedge members respectively disposed between each counter-surface and an associated ridge at least one of said wedge members being displaceable by said screw of said first clamping means.

5. The device defined in claim 1 wherein said clamping surface and a juxtaposed portion of said wedge have mutually engaging saw-tooth configurations.

6. The device defined in claim 1 wherein said counter-surface has chisel-shaped formations.

7. The device defined in claim 1 wherein said retainer is a U-profile straddling said edge.

8. The device defined in claim 1 wherein said second clamping means includes a U-shaped clamping member received in a window formed in said anchor flange and straddling same, a lever fixed to said clamping member and having free end engaged by said screw of said second clamping means, and means forming a fulcrum for said lever against which said end of said lever is drawn by said screw of said second clamping means.

9. The device defined in claim 8 wherein said clamping member has shanks with recesses receiving said bolt.

10. The device defined in claim 8 wherein said means forming said fulcrum includes a ridge formed on said frame element.

* * * * *